United States Patent [19]

Mancini et al.

[11] 4,178,189

[45] Dec. 11, 1979

[54] APPARATUS AND METHOD FOR CLEANING AND POLISHING CARTRIDGE CASES

[76] Inventors: Angelo J. Mancini, P.O. Box 545; Ronald W. Galloway, Rte. 1, both of Afton, Wyo. 83110

[21] Appl. No.: 914,206

[22] Filed: Jun. 12, 1978

[51] Int. Cl.[2] ..... B08B 7/100

[52] U.S. Cl. ..... 134/6; 134/33; 51/217 T; 82/40 R; 29/1.3; 86/23; 15/268

[58] Field of Search ..... 279/8; 269/246, 287; 29/1.3, 1.31, 1.32; 86/44, 23; 15/268; 134/6, 33; 51/217 T

[56] References Cited

U.S. PATENT DOCUMENTS

| | | | |
|---|---|---|---|
| 2,744,307 | 5/1956 | Smiley | 29/1.32 |
| 3,818,563 | 6/1974 | Beaulieu | 29/1.32 |

*Primary Examiner*—S. Leon Bashore
*Assistant Examiner*—Mike Goldman
*Attorney, Agent, or Firm*—Criddle, Thorpe & Western

[57] ABSTRACT

A tool for mounting a cartridge case to a drill chuck for rotating the cartridge case about its longitudinal axis for the purpose of cleaning and polishing the cartridge case. The tool comprises a body member having a bore extending axially from one end thereof to the other end, with at least a portion of the bore being internally threaded. One end of the body member is provided with an undercut slot extending from the periphery thereof inwardly to encompass the bore therein. The undercut slot is adapted to receive the flanged end of a universal cartridge case shellholders. A shaft, at least a portion thereof having external threads, is positioned within the bore in the body member so that the threads on the shaft engage the threads of the bore. The shaft is of sufficient length to extend through the bore in the body member from said one end thereof to and beyond the other end so as to project outwardly from the other end. In using the tool, a shellholder which is adapted to engage the base of the cartridges to be cleaned is inserted into the undercut slot in the end of the tool. A cartridge case is mounted to the shellholder so that the cartridge case extends outwardly from the body member of the tool in axial alignment with the bore in the body member. The shaft is then advanced in the bore of the body member to make firm contact with the base of the cartridge case, and thereby bind the body member, shaft, and cartridge case in locked engagement as a rigid unit. The projecting end of the shaft is connected to a drill chuck for rotation of the cartridge. The rotating cartridge case is easily cleaned and polished by contacting it with a mildly abrasive material such as steel wool.

5 Claims, 2 Drawing Figures

APPARATUS AND METHOD FOR CLEANING AND POLISHING CARTRIDGE CASES

BACKGROUND OF THE INVENTION

1. Field of the Invention

The invention relates to the handling of cartridge cases and more particularly to method and apparatus for cleaning and polishing cartridge cases prior to reloading them with powder for reuse.

2. State of the Art

Reloading of rifle and pistol cartridge cases has become popular with sportsmen throughout the world for reusing cartridge cases which have been fired rather than wastefully discarding such used cases. Once the cartridge cases have been used, however, they tend to become dirty and oxidized prior to the time when the sportsman has time to reload them. The dirt and oxidation on the exterior of the cartridge cases, besides looking bad, causes two serious problems when the cases are reloaded are reused. First, in the reloading of such cases, the dirt and grime on the exterior of the cases scratch and otherwise harm the interior surfaces and other parts of the reloading dies, and, in addition, the dirty cartridge cases have a tendency to stick in the reloading dies. Second, the dirty cartridge cases which have been reloaded for reuse scratch and otherwise damage the chamber of the rifle or pistol in which they are used, and in some instances will stick to the chamber of the rifle or pistol.

Heretofore, reloaders have had to generally resort to manual scrubbing of the dirty cartridge cases, or to cleaning the cases in rock-tumbling apparatus, which is very slow, very messy, and quite expensive.

Objectives

The principal objective of the present invention is to provide a simple method and apparatus which can be used in conjunction with a rotary drill to quickly and easily clean and polish used cartridge cases. A particular object of the invention is to provide a tool which is used with standard cartridge case shellholders to quickly and easily mount a cartridge case to a drill chuck for rotating the cartridge case about its longitudinal axis, so that the rotating cylindrical surface of the cartridge case can be cleaned and polished by contacting the rotating surface with a mild abrasive material, such as steel wool.

SUMMARY OF THE INVENTION

The above objectives are achieved in accordance with the present invention by providing a tool in which the principal features comprise a body member having a bore extending axially from one end to the other; means at one end of the body member which, using standard cartridge case shellholders, is adapted for mounting the rim end of a cartridge case so that the cartridge case extends longitudinally outwardly from the end of the body member in substantially axial alignment with the bore therein; and an elongate shaft having external threads along at least a portion of its longitudinal surface. The threaded portion of the shaft is adapted to engage the threads of the bore in the body member, and the shaft is of sufficient longitudinal length to extend through the bore in the body member from the end to which the cartridge case is mounted to and beyond the other end so as to project outwardly from the other end in axial alignment with the bore.

In using the tool, a standard cartridge case shellholder which is of the proper size to engage the base of the cartridge to be cleaned is mounted to the end of the body member, and a cartridge is, in turn, mounted on the shellholder so that the cartridge case extends outwardly from the body member in axial alignment with the bore in the body member. The shaft is advanced toward the end of the body member, through the center opening of the shellholder, and into forced contact with base of the cartridge case, whereby the body member, shaft, and cartridge case are releasably bound together in locked engagement as a rigid unit. The free end of the shaft which projects from the body member is readily attached to a drill chuck. The drill chuck is then rotated so as to rotate the cartridge case about its longitudinal axis, and the exterior surface of the cartridge case is quickly cleaned and polished by contacting it with a mildly abrasive material, such as steel wool. A distinct advantage of the tool of this invention is that the longitudinal, exterior surface of the cartridge case is accessible for uniform, easy application of the abrasive material so that such surface is uniformly cleaned and polished quickly and easily.

Cleaning of a number of cartridge cases is also accomplished quickly and easily. The cleaned cartridge case is removed from the tool by turning the body member approximately one-quarter turn so as to retract the shaft from its binding contact with the base of the cartridge case, and the cartridge case is then dismounted from the shellholder at the end of the body member. The next cartridge to be cleaned is mounted in the shellholder, and the body member is turned about one-quarter turn so as to advance the shaft into forced contact with the base of the cartridge case, thereby binding the cartridge case to the tool as a rigid unit. The drill chuck is then rotated and the cartridge case is contacted with the cleaning medium. Any number of subsequent cartridge cases are handled in like manner. As will be appreciated, the tool need not be removed from the drill chuck between cleaning of subsequent cartridge cases, even cartridge cases of various sizes, as will be more fully explained hereinafter.

Additional objects and features of the invention will become apparent from the following detailed description, taken together with the accompanying drawing.

THE DRAWING

In the drawing:

FIG. 1 is an exploded perspective view of a tool in accordance with the invention; and FIG. 2, a cross-sectional view taken along line 2—2 of FIG. 1 and showing the rim end of a cartridge case engaged in the tool.

DETAILED DESCRIPTION

Figure 1:
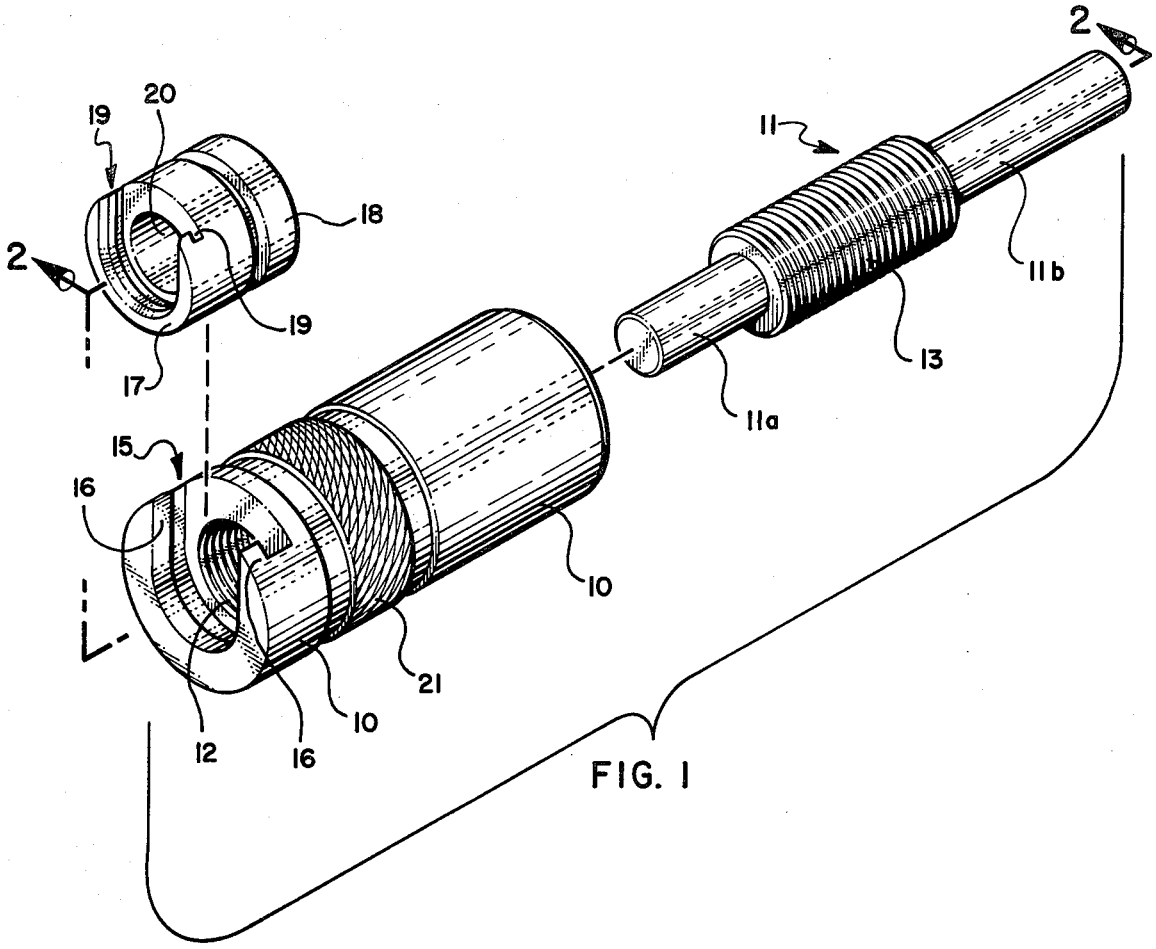
Figure 2:
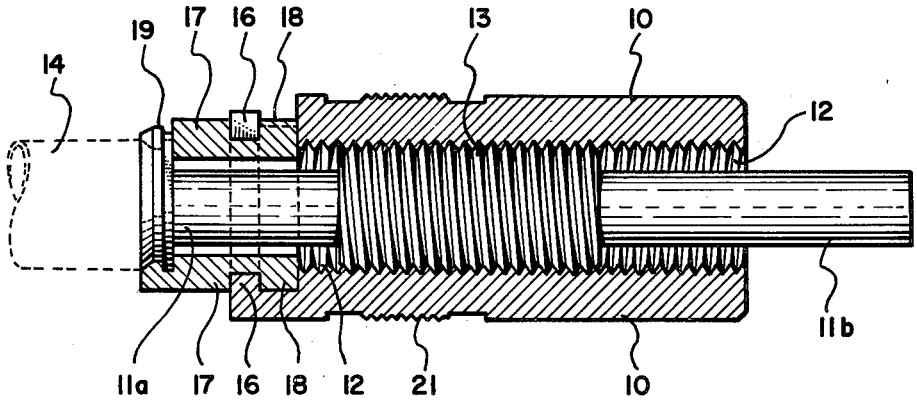

Referring now to the drawings:

A preferred embodiment of the tool of this invention is shown in FIGS. 1 and 2 comprising a body member 10 having a bore 12 extending axially from one end to the other end of the body member 10. At least a portion of the bore 12 is internally threaded, and, advantageously, the bore 12 internally threaded throughout its length as illustrated.

A shaft 11 is provided, of which at least a portion of its longitudinal surface has external threads 13 which are adapted to engage the threads of the bore 12 in body member 10 as illustrated in FIG. 2. The shaft 11 is designed and adapted to move to and fro in the bore 12 of body member 10, depending upon the direction of the relative rotational movement between it and the body member 10. The shaft 11 is of sufficient length to extend through the bore 12 from one end of the body member 10 to and beyond the other end thereof so as to project outwardly from the other and in axial alignment with the bore 12. As illustrated, the shaft 11 comprises the threaded section 13 having two elongate sections 11*a* and 11*b* extending axially from the respective ends of the threaded section. The two end sections 11*a* and 11*b* may have a smaller diameter than the threaded section 13; however, the only requirement is that no part of shaft 11 shall have a size large enough so that the shell 11 can not move freely in either direction through bore 12.

Means are provided at one end of the body member 10 for mounting the rim end of a cartridge case 14 (FIG. 2) thereto so that the cartridge case 14 extends outwardly from the end of the body member 10 in substantially axial alignment with the bore 12 therein. As illustrated, the end of the body member 10 is provided with an undercut slot 15, as best seen in FIG. 1. The slot 15 extends from the periphery of the body member 10 inwardly to encompass the bore 12. The overhanging lip portion 16 of slot 15 is adapted to receive the flanged end 18 of a standard cartridge case shellholder 17 in sliding movement from the periphery of the body member 10 towards the bore 12. The shellholder 17 is a standard item used with reloading apparatus for attaching cartridge cases thereto. Such shellholders are cylindrical in shape with an undercut slot 19 in the end thereof opposite the flanged end 18. The flange at the end 18 is of universal size so as to be adapted for use in all reloading tools. The slot 19 extends from the periphery of the holder 17 inwardly to the bore 20 thereof. The slot 19 is adapted to receive the base of the cartridge case 14 in sliding movement from the periphery of the holder 17 so as to be positioned in axial alignment over the bore 20 therein.

When the shellholder 17 and a cartridge case 14 engaged therein are attached to the end of the body member 10 of the present tool (as shown in FIG. 2), the bore 12 of the body member 10 is in axial registry with the bore 20 of shellholder 17, and, thus, when the shaft 11 is advanced in the bore 12, the leading end 11*a* thereof contacts the base of the cartridge case 14. A knurled section 21 (FIG. 1) is advantageously provided on the surface of body member 10 for gripping and turning the body member 10 in establishing firm contact between the shaft 11 and cartridge case 14. The force exerted on the cartridge case 14 by the shaft 11 binds the cartridge case 14, shellholder 17, body member 10, and shaft 11 together in locked engagement as a rigid unit. The trailing portion 11*b* of the shaft 11 which extends from the opposite end of the body member 10 is readily attached to a drill chuck (not shown) for rotating the cartridge case about its longitudinal axis.

Advantageously, the shaft 11 has a circular cross-section as illustrated; however, it should be recognized that the shaft could have a polygonal cross-section, especially the sections 11*a* and 11*b* thereof which extend from the threaded section 13. Such polygonal cross-sections are commonly used on the arbors of drills for more positive engagement with the drill chuck.

In using the tool, it is advantageous to attach the trailing section 11*b* of the shaft 11 to the drill chuck and then secure the cartridge case to the body member 10 by mounting the cartridge case in the shellholder 17 at the end of the body member 10. The cartridge case and body member 10 are then rotated with respect to the shaft 11 until the leading end of the shaft 11 makes forced contact with the base of the cartridge case, thereby binding the cartridge case, shellholder, body member, and shaft together as a rigid unit. Numerous cartridge cases, even of various calibers, can be quickly cleaned and polished without removing the tool from the drill chuck, by simply turning the body member 10 to release the grip on the previously cleaned cartridge case, removing such case, mounting an uncleaned case on the tool, and turning the body member 10 to contact the cartridge case and bind it to the tool as a rigid unit. In these instances when the next, uncleaned cartridge case is of a different caliber than the previously cleaned one and will, thus, not properly fit within the slot of the shellholder used with the previously cleaned cartridge, the shellholder is simply removed and replaced with one of proper size for the next cartridge, and the uncleaned cartridge is then mounted therein. The body member 10 is then turned sufficiently so that the shaft 11 makes forced contact with the base of the uncleaned cartridge case. As little as 5 to 11 seconds contact of the rotating cartridge cases with the mildly abrasive material is all that is required to very effectively clean and polish the exterior surfaces of the cases.

Although a preferred embodiment of the invention has been described in detail herein, it is to be understood that the present disclosure is made by way of example and that various other embodiments are possible without departing from the subject matter coming within the scope of the following claims, which subject matter is regarded as the invention.

We claim:

1. A tool for mounting a cartridge case to a drill chuck for rotating the cartridge case about its longitudinal axis, said tool comprising:

a universal shellholder;

a body member having a bore extending axially from one end thereof to the other, with at least a portion of the bore being internally threaded;

an undercut slot at one end of said body member extending from the periphery of the body member radially inwardly to said bore, said slot being adapted to receive the flanged end of said universal shellholder in sliding movement from the periphery of the body member towards the bore, so that the central opening through said shellholder is in substantial axial alignment with said bore; and a shaft which has external threads along at least a portion of the longitudinal surface thereof, with the threaded portion of the shaft being adapted to engage the threads of the bore in said body member, said shaft having a sufficient longitudinal dimension to extend through the bore in said body member from said one end to and beyond the other end thereof so as to project outwardly from said other end in axial alignment with said bore, whereby when the rim end of a cartridge case is engaged in said shellholder and when said shaft is advanced toward said one end of said body member, the lead end of said shaft extends through the opening in said shellholder and contacts the end of the cartridge case, thereby binding the body member, shaft, shellholder, and cartridge case in locked engagement as a rigid unit, with the portion of the shaft projecting from the body member being adapted for engagement with a drill chuck.

2. A tool in accordance with claim 1, wherein said shaft comprises a threaded, first section adapted to engage the threads of the bore in said body member and a elongate, second section extending axially from one of said first section and adapted to project from said other end of said body member for engagement with a drill chuck, said second section having a smaller cross-sectional dimension than the corresponding dimension of said first section.

3. A tool in accordance with claim 3, wherein said shaft also has an elongate, third section extending axially from the opposite end of that from which said first section extends, said third section having a smaller cross-sectional dimension than the corresponding dimension of said first section, with the free end of said third section adapted to contact the end of the cartridge case when said shaft advances in the threaded bore of said body member.

4. A method of cleaning and polishing cartridge cases prior to reloading of the cartridge cases, comprising:

positioning a cartridge case in engagement with one end of a universal shellholder which has a bore extending axially from said one to the other end thereof;

attaching said other end of said shellholder to one end of a body member which has a bore extending axially from said one end to the other end thereof, said shellholder being attached to said body member so that the respective bores in the shellholder and body member are in alignment, said bore in said body member being internally threaded along at least a portion of its length;

threading a shaft which has external threads along at least a portion of its longitudinal length into engagement with the threaded portion of said bore in said body member so as to advance the lead end of said shaft into contact with the base of the cartridge case at said one end of said universal shellholder, thereby binding the cartridge case, universal shellholder, body member, and shaft in locked engagement as a single unit, said shaft being of sufficient longitudinal length so that the trailing end thereof projects outwardly from said other end of said body member when the leading end is advanced into contact with said cartridge case;

connecting the trailing end of said shaft to a drill chuck;

rotating the drill chuck so as to rotate the cartridge case about its longitudinal axis; and contacting the rotating cartridge case with a mildly abrasive material, such as steel wool, to clean and polish the cartridge case.

5. A method of cleaning and polishing cartridge cases in accordance with claim 4, wherein additional cartridge cases are cleaned and polished by the subsequent steps of:

turning the body member of said tool to retract the leading end of said shaft from contact with the base of said cartridge case;

removing the cleaned and polished cartridge case from said shellholder;

positioning the next cartridge case to be cleaned in engagement with said shellholder;

turning the body member to advance the leading end of said shaft into contact with the base of the cartridge case;

rotating the drill chuck so as to rotate the cartridge case about its longitudinal axis; and contacting the rotating cartridge case with a mild abrasive material, such as steel wool, to clean and polish the cartridge case.

* * * * *